United States Patent [19]

Asija

[11] 4,107,462

[45] Aug. 15, 1978

[54] ELECTROVENTRILOQUIST

[76] Inventor: Satya Pal Asija, 2015 Butler Ave., S. St. Paul, Minn. 55075

[21] Appl. No.: 805,140

[22] Filed: Jun. 9, 1977

[51] Int. Cl.[2] ..... A63H 3/33

[52] U.S. Cl. ..... 179/1 VC; 40/457; 40/126 B; 46/227; 340/148

[58] Field of Search ..... 179/1 R, 1 VC, 100.1 VC; 46/227, 232; 40/28.3, 126 B; 340/148

[56] References Cited

U.S. PATENT DOCUMENTS

| | | | |
|---|---|---|---|
| 1,774,653 | 9/1930 | Marriott et al. | 179/1 R |
| 2,700,250 | 1/1955 | Williams | 46/232 |
| 2,867,049 | 1/1959 | Brackensey | 40/28.3 |
| 2,942,380 | 6/1960 | Coulter | 46/232 |
| 2,957,273 | 10/1960 | Hughes et al. | 46/227 |
| 3,162,977 | 12/1964 | Elischer | 46/118 |
| 3,190,037 | 6/1965 | Giordano | 46/232 |
| 3,287,849 | 11/1966 | Weiss | 46/232 |
| 3,394,491 | 7/1968 | Valentine | 46/232 |
| 3,440,347 | 4/1969 | Spencer et al. | 179/1 VC |
| 3,582,671 | 6/1971 | Ott | 340/148 |
| 3,739,521 | 6/1973 | Fox | 46/232 |
| 3,898,383 | 8/1975 | Herbits | 179/1 VC |

FOREIGN PATENT DOCUMENTS

| | | | |
|---|---|---|---|
| 927,077 | 5/1963 | United Kingdom | 40/126 B |

*Primary Examiner*—George G. Stellar
*Attorney, Agent, or Firm*—Satya Pal Asija

[57] ABSTRACT

An electronic version of a ventriloquism vent (popularly known as 'dummy'). It is a real time talking apparatus capable of simulating a live debate with a human ventriloquist. The electroventriloquist comprises a microphone, an amplifier, a loudspeaker, a voice controlled circuit and plurality of lights and moving members. The microphone is worn on the throat, which is activated by a foot switch which creates the illusion that the sound is coming from the electroventriloquist. The voice also modulates lights and moving parts in synchronization with the sound intensity. The eyes and lips of the electroventriloquist are electronic lights which blink in harmony with the voice being generated by the loudspeaker. A plurality of gadgets to suit the personality of the electroventriloquist for a given application are added.

3 Claims, 2 Drawing Figures

ELECTROVENTRILOQUIST

BACKGROUND OF THE INVENTION

1. Field of the Invention

This invention relates to ventriloquism. Specifically it is an electronic version of a ventriloquism vent (known as 'dummy' in the ventriloquism parlance). It may be thought of as a talking computer, machine, or apparatus.

2. Background of the Prior Art

Ventriloquism devices of the prior art are strictly mechanican in nature, which require simulation of their lip movement by the hand of the human ventriloquist at the rate of approximately one cycle per syllable. It is difficult for the novice ventriloquist to concentrate on the script as well to coordinate the lip movement of the dummy in synchronization with syllables of the speech. The electroventriloquist of this invention, on the other hand is activated by a simple switch, leaving both hands of the ventriloquist free to handle the script or to make gestures, etc. Another limitation of the ventriloquism devices of the prior art is that the dummy cannot be placed at a distance greater than the length of the arm of the human ventriloquist, whereas this device can be placed hundreds of feet away to create special effects merely connecting cables long enough. Another limitation of the ventriloquism devices of the prior art is that the same cannot be configured into the shape of a computer or other talking apparatus and therefore vents of the prior art are limited to variations of play dolls. The electroventriloquist of this invention can be configured into any shape or size of apparatus.

SUMMARY

The electroventriloquist of this invention comprises one or more microphones, normally closed momentary switches preferably foot operated, amplifiers, loudspeakers, a voice control circuit capable of modulating power between an input plug and output socket in synchronization with the sound intensity in the loudspeaker, and an electroventriloquist housing which has a translucent plate on the side facing the audience. Plurality of lights powered through said output socket are strategically mounted in the housing behind the translucent plate. In addition some moving parts such as a small motor may be powered through said output socket and mounted on the outside surface of the translucent plate facing the audience. Furthermore other auxiliary gadgets such as a real time clock and an electronic strobe may be visibly mounted in the electroventriloquist housing to create special effects to suit the personality of the electroventriloquist. Said auxiliary gadgets should be powered directly by the conventional 110 voltage supply so that these gadgets can maintain their proper function without the control of the voice modulation. The microphone, the switch and the amplifier are placed close to the human ventriloquist. On the other hand the loudspeaker, voice control circuit, lights, moving parts, and auxiliary gadgets are mounted in the electroventriloquist housing. In addition to the lights in the ventriloquist housing behind the translucent plate, a face may be painted or otherwise simulated on the translucent plate with electric lights powered through said output socket forming the eyes and the lips of ventriloquist of this invention. Other changes may be made without deviating from the spirit of said invention.

DESCRIPTION OF THE PREFERRED EMBODIMENT

Figure 1:
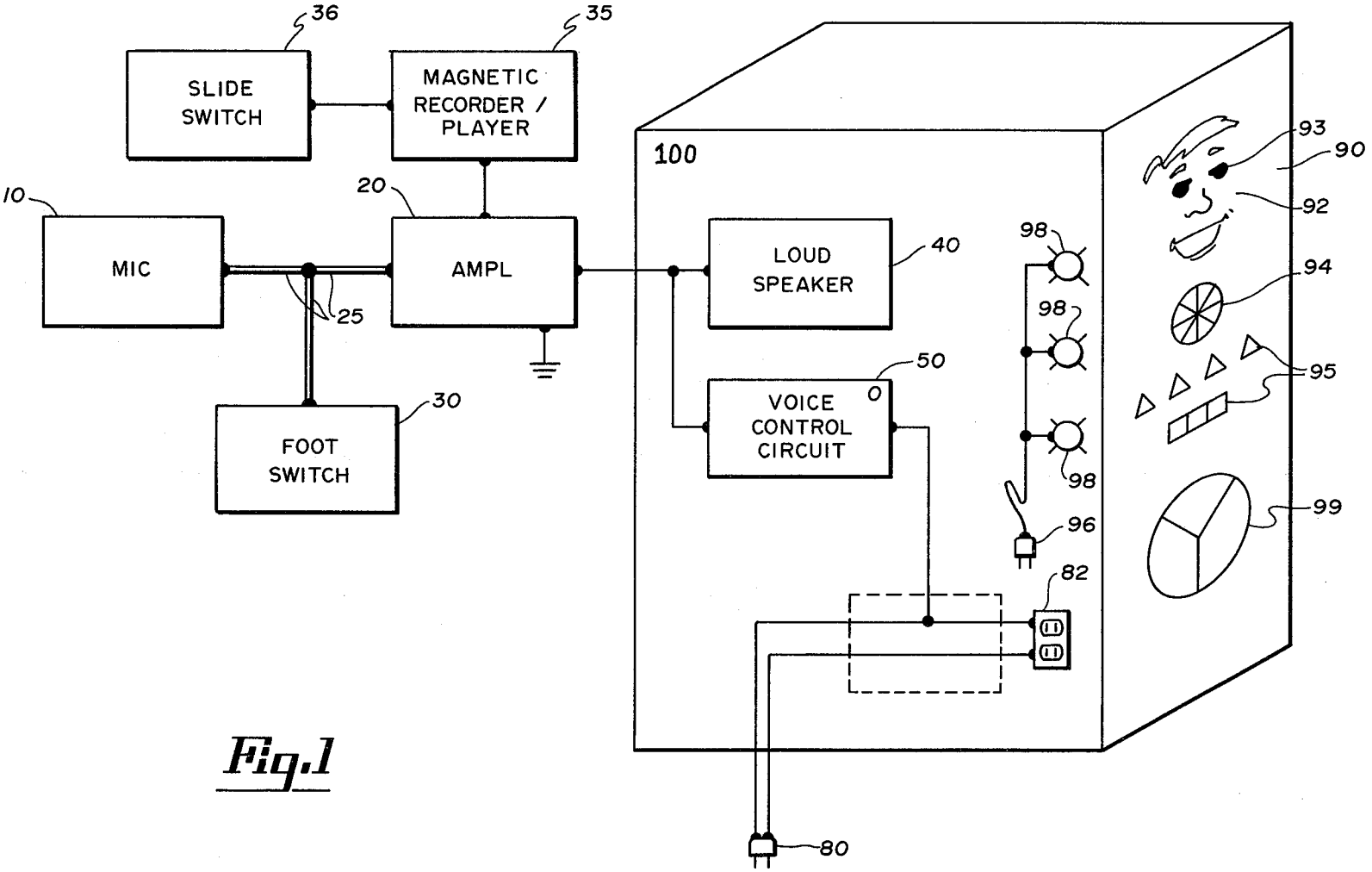
FIG.1 is a block diagram of the electroventriloquist of this invention.

A block diagram of the preferred embodiment of the 'Electroventriloquist' is shown in FIG. 1, wherein a microphone 10 is connected to an audio public address amplifier 20 via a foot controlled momentary normally closed switch 30 with shielded cables 25 such that when the foot is depressed the audio microphone amplifier circuit is energized. The output of the audio amplifier 20, is fed to a loudspeaker 40. A portion of the audio amplifier output 20 is also fed to a voice control circuit 50, which interrupts conventional power between a plug 80 and a socket 82, in synchronization with the sound intensity such that root mean square voltage available at the output socket 82 is directly proportional to the sound intensity in the loudspeaker 50. Accordingly any lights or moving devices plugged into socket 82 vary in intensity or speed in harmony with the sound from the electroventriloquist.

The microphone 10, the amplifier 20 and the foot switch 30 are mounted in close proximity to the human ventriloquist, where as loudspeaker 40, voice control circuit 50 and output socket 82 are mounted in a mechanical electroventriloquist housing 100. One side plate 90 of said ventriloquist housing 100 is translucent and faces the audience in an actual performance or debate between the human ventriloquist and the electroventriloquist. A face 92 is simulated on the said translucent plate 90, with electric lights 93 and moving devices 94 which are powered from said socket 82. For example the entire boundary of the face may be neon lights or just the eyes and lips may be simulated by light bulbs to suit the personality of the electroventriloquist as well as the personal preferences of the human ventriloquist. In addition other auxiliary gadgets 95 such as a strobe and/or a real time digital clock or a counter may be mounted on said translucent plate but are powered directly from the conventional voltage supply. To enhance the effect of voice modulation additional lamps 98 may be mounted behind the translucent plate 92 such that the lamps are not visible but the light from said lamps is visible to the audience. For modularity and convenience lamps 98 are connected to a conventional plug 96 which in turn is plugged into said socket 82, which has plurality of outputs. In addition plurality of passive devices 99 such as a magnetic tape reel, knobs or switches may be mounted to suit the personality of the electroventriloquist for a particular occasion and theme. In addition potentiometers may be added in series to regulate the output of loudspeaker, lights or moving devices. An example of volume control is shown in FIG. 2 where potentiometer 39 is connected in series with the loudspeaker.

Figure 2:
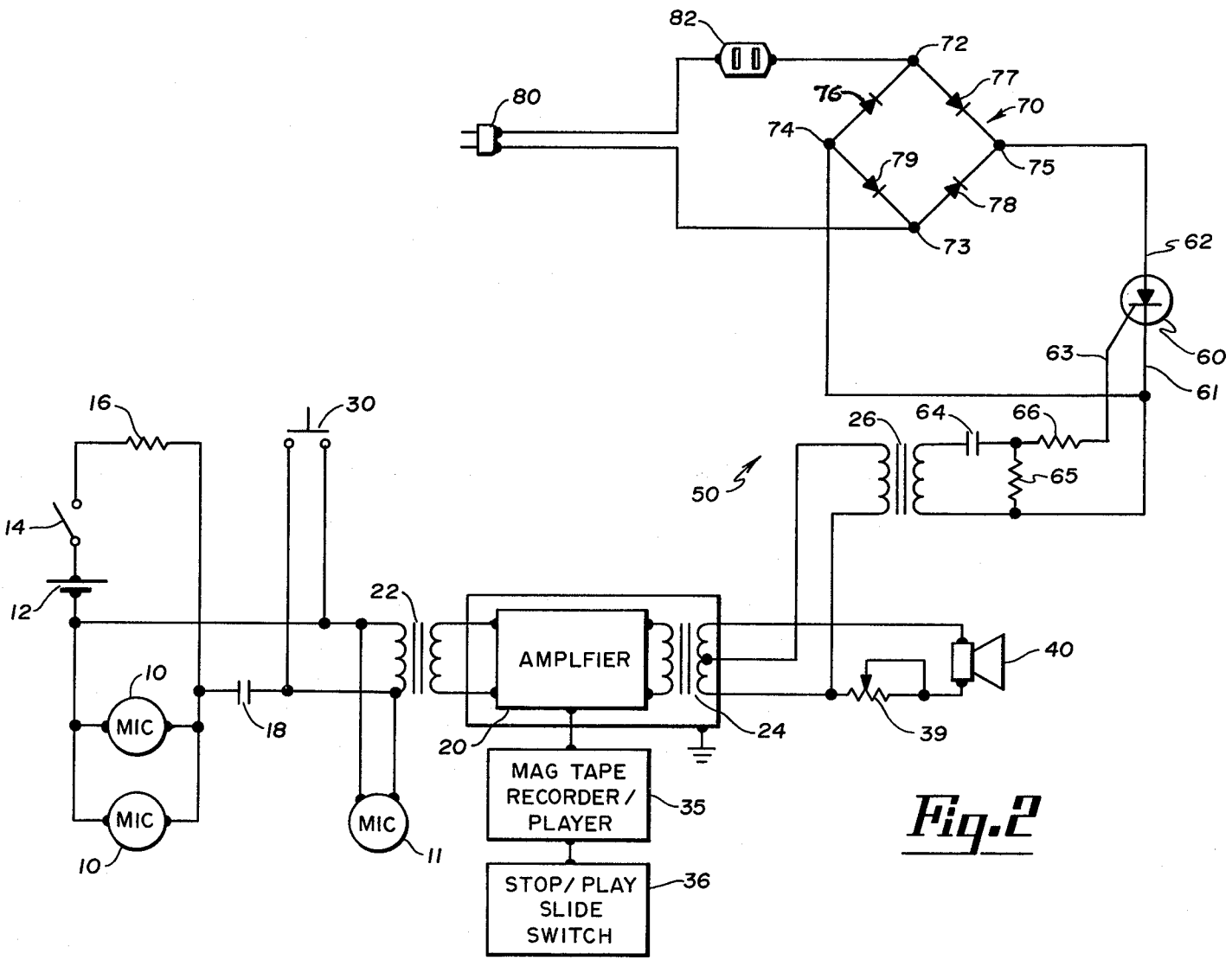
FIG. 2 is a circuit diagram of the electroventriloquist of this invention.

FIG. 2 of the electroventriloquist of this invention shows the detailed circuit diagram of the preferred embodiment. One or more microphones 10 in parallel, one of them being a throat microphone are connected in series with a small direct current battery 12, a toggle switch 14 and a resistor 16. A capacitor 18 is connected to one end of the microphone 10. A normally closed momentary foot switch 30 is connected between the other end of said capacitor 18 and the common end of said microphones 10 with the direct current battery 12. Additional normally closed momentary hand held switches (not shown in the circuit) may be connected in series with the said switch 30. The output of the microphone 10, available in parallel with the switch 30 is also fed to an amplifier 20 via an impedance matching transformer 22 if necessary as to make the output impedance of the microphone 10 higher than the input impedance of the amplifier 20, if such is not already the case. All connections between the microphones 10 and the amplifier 20 and the switch 30 must be with shielded cables 25.

The output of the amplifier 20 is connected to a loudspeaker 40 through an impedance matching transformer 24. A portion of the output of the impedance matching transformer 24 is connected to the primary of another miniature audio transformer 26, the output of which is used to control the flow of R.M.S. (Root Mean Square) voltage between an input plug 80 and output socket 82 via an SCR (Silicon Controlled Rectifier) 60; or a triac which in turn is equivalent to two silicon controlled rectifiers connected back to back in parallel. One end of the secondary of said miniature audio transformer is connected to gate 63 of said SCR 60 via a capacitor 64 and a resistor 66. The common end between said capacitor 64 and said resistor 66 is connected to the remaining end of the secondary of said miniature audio transformer 26 as well as cathode terminal 61 of said SCR 60 via a resistor 65. Furthermore one conductor of input plug 80 is connected to one conductor of output socket 82. The remaining ends of input plug 80 and output socket 82 are connected to alternating current terminals 72, 73 of a diode bridge rectifier 70. The main purpose of diode bridge rectifier 70 is that it allows an SCR to conduct in both half cycles of alternating current supply as if it were a triac. Where a triac is used in lieu of SCR 60, the need for bridge rectifier 70 is obviated. In which case terminals T1 & T2 61, 62 are connected directly to remaining conductors of input plug 80 and output socket 82 as disclosed by the applicant in 'Low Power Remote Switch Device' U.S. Pat. No. 3,886,376 issued May 27, 1975. Otherwise Cathode 61 and anode 62 of said SCR 60 are connected across direct terminals 74, 75 of said diode bridge rectifier 70, such that when the SCR 60 conducts, terminals 74, 75 are shortcircuited. Said diode rectifier bridge may be constructed by interconnecting 4 diodes 76 through 79, by connecting cathodes of two diodes 77, 78 at terminal 75 and anodes of two diodes 76, 79 at terminal 74. The remaining ends of the diodes are 76–79, joined to form alternating current terminals 72 & 73.

Following is a listing of the components used in the preferred embodiment along with their typical values wherever applicably arranged in an ascending order of reference numerals:

10 = Throat microphone such as electrovoice model T-30-S#.
11 = Voice microphone.
12 = A direct current battery of approximately 1 volt.
14 = Normally open momentary push button type switch.
16 = A resistor approximately 200 ohms, ⅛ watt.
18 = A capacitor of 0.5 microfarad capacity.
20 = A public address amplifier such as Radio Shack MPA-20.
22 = Impedance matching input transformer.
24 = Impedance matching output audio transformer.
25 = Shielded cable for microphone connections.
26 = Isolation coupling transformer.
30 = Normally closed momentary foot switch.
35 = Analog magnetic recorder player.
36 = An on off slide switch.
40 = Loudspeaker.
50 = Voice control circuit.
60 = Silicon controller rectifier.
61 = Cathode of a silicon controlled rectified.
62 = Anode of the silicon controlled rectifier.
63 = Gate of the silicon controlled rectifier.
64 = Coupling capacitor of 5 microfarad capacity.
65 = A resistor of approximately 5 killo ohms.
66 = 500 ohm resistor.
70 = Diode bridge rectifier.
72 = Alternating current terminal of bridge rectifier.
73 = Alternating current terminal of bridge rectifier.
74 = Negative direct current terminal of bridge rectifier.
75 = Positive direct current terminal of bridge rectifier.
76 = Diode
77 = Diode
78 = Diode
79 = Diode
80 = Input plug.
82 = Output socket.
90 = Ventriloquist housing with computer appearance.
92 = Translucent plate.
93 = Electric eye.
94 = Electromechanical moving part such as a fan.
95 = Auxiliary gadgets such as strobe, real time digital clock, counter, etc.
96 = Input plug.
98 = Plurality of light bulb and sockets.
99 = Passive devices such as a magnetic tape reel.
100 = Electroventriloquist housing.

OPERATION

The human ventriloquist wears a throat microphone 10 or has another type of microphone within his voice range. The human ventriloquist presses the foot switch 30 to remove the short circuit at the microphone output terminals thereby allowing the amplifier 20 to magnify the sounds generated by the human ventriloquist. For the sake of convenience the ventriloquist may also have one or more hand held switches connected in series with said foot switch 30. It is apparent that activation of any switch will remove the short circuit. When the circuit is not being used, one either removes the battery 12 from its housing or turns off the switch 14 to conserve the life of said battery 12. In a debate with electroventriloquist the human ventriloquist talks normally for his part of the dialogue and for apparatus part of the dialogue activates the switch 30 and stops lip movement and gestures, etc, according to the state of the art of ventriloquism. It is not necessary for him to generate lip movement of the dummy with hands as is the case with the prior art. Thus the sound appears to come from the electroventriloquist during the dialogue of the latter even though actually the human ventriloquist is talking.

Since a portion of the loudspeaker output is connected to the gate 63 of the SCR 60 via a miniature audio transformer 26 and capacitor 64 and resistor 66, the SCR 60 conducts during those portions of alternating current supply when the gate 63 is at higher potential with respect to cathode terminal 61, which is the case when the sound output exceeds a certain threshold. This threshold can be varied by changing the values of the resistor capacitor network of components 64, 65 and 66. As the SCR 60 conducts terminals 74, 75 of diode bridge rectifier 70 are short circuited, which provides a path between the input plug 80 and output socket 82 through diodes 76 and 78 during one half cycles of supply and through diodes 77 and 79 during remaining half cycles of the supply voltage in either case via short circuited terminals 74, 75 thereby making available at the output socket same voltage as is applied to the input plug 80. Due to the fast response of the audio circuit and the triac of the order of milliseconds the supply to load socket 82 may be interrupted several times during one cycle depending upon the speech speed and intensity of the human ventriloquist. Thus any devices such as lamps and moving parts powered through output socket 82 modulate in intensity or speed in synchronization with the speech speed and intensity providing the foot switch is pressed.

The applicant claims:

1. An electroventriloquism apparatus comprising:

(a) a throat microphone;

(b) an amplifier connected to said throat microphone;

(c) a normally closed momentary foot switch connected to said throat microphone and said amplifier so as to normally short circuit the input to said amplifier;

(d) a loudspeaker connected to said amplifier;

(e) a voice modulated control circuit connected to the output of said amplifier; and (f) plurality of lights and electromechanical devices powered via said voice actuated control circuit; and wherein said voice actuated control circuit comprises:

(g) an input plug;

(h) an output socket connected in series with said input plug;

(i) a diode bridge rectifier with its alternating current terminals connected across said series combination of said input plug and said output socket;

(j) a silicon controlled rectifier with its anode connected to positive direct current terminal of said diode bridge rectifier and its cathode connected to negative direct current terminal of said diode bridge rectifier;

(k) a coupling transformer with its primary terminals connected to said loudspeaker and one of secondary terminals connected to said cathode of said silicon controlled rectifier and the other secondary terminal connected to gate of said silicon controlled rectifier via a capacitor and a first resistor; and (l) a second resistor connected to said cathode of said silicon controlled rectifier and the junction of said capacitor and said first resistor; and wherein:

(m) a magnetic tape recorder cum player prerecorded with machine part of the dialogue is connected to another input of said amplifier; and (n) a slide switch is connected in series with the power supply of said magnetic tape recorder cum player.

2. A process of debating with an electroventriloquism apparatus of this invention comprising the steps of:

(a) connecting a microphone in the vicinity of the human ventriloquist;

(b) sensing the audio from the microphone without lip movement of the human ventriloquist;

(c) amplifying the audio via an amplifier;

(d) short circuiting the output of said microphone during the human part of the dialogue;

(e) placing a loudspeaker connected to said amplifier within said electroventriloquism apparatus;

(f) modulating the lights and other electromechanical devices as a function of said amplifier output;

(g) pre-recording certain sounds on a tape recorder;

(h) open circuiting the power to said tape recorder during the machine part of the dialogue and during special sound effects; and (i) controlling strobe rate of lights.

3. An electroventriloquism apparatus comprising:

(a) plurality of microphones strategically located in the vicinity of a human ventriloquist;

(b) plurality of switches for enabling and disabling the output of said plurality of microphones;

(c) an amplifier with plurality of inputs connected to said plurality of microphones;

(d) plurality of housings containing plurality of loudspeakers connected to said amplifier via an impedance matching output transformer;

(e) designs implanted on said housings to create the appearance of a talking machine;

(f) a voice controlled power circuit; and wherein said voice controlled power circuit comprises:

(g) an input plug and an output socket connected in series;

(h) a diode bridge rectifier with its alternating current terminals connected to said series combination of input plug and output socket;

(i) a silicon controlled rectifier with its anode connected to positive direct current terminal of said diode bridge rectifier and its cathode connected to negative direct current terminal of said diode bridge rectifier;

(j) a coupling transformer with its primary terminals connected to said plurality of loudspeakers and one of secondary terminals connected to said cathode of said silicon controlled rectifier and the other secondary terminal connected to gate of said silicon controlled rectifier via a capacitor and a first resistor; and (k) a second resistor connected to said cathode of said silicon controlled rectifier and the junction of said capacitor and said first resistor; and wherein;

(l) plurality of lights and electromechanical devices are powered via said voice controlled power circuit;

(m) a magnetic tape recorder cum player pre recorded with special sound effects is connected to an input of said amplifier; and (n) a slide switch is connected in series with the power supply of said magnetic tape recorder cum player.

* * * * *